US007269365B2

(12) United States Patent
Mochizuki et al.

(10) Patent No.: US 7,269,365 B2
(45) Date of Patent: Sep. 11, 2007

(54) IMAGE HEATING APPARATUS

(75) Inventors: Keisuke Mochizuki, Susono (JP); Junji Suzuki, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/626,056

(22) Filed: Jan. 23, 2007

(65) Prior Publication Data

US 2007/0116481 A1 May 24, 2007

Related U.S. Application Data

(63) Continuation of application No. PCT/JP2006/315244, filed on Jul. 26, 2006.

(30) Foreign Application Priority Data

Jul. 26, 2005 (JP) ..... 2005-216150

(51) Int. Cl.
*G03G 15/20* (2006.01)

(52) U.S. Cl. ..... 399/33

(58) Field of Classification Search ..... 399/33, 399/320, 328–335

See application file for complete search history.

(56) References Cited

U.S. PATENT DOCUMENTS 6,075,228 A * 6/2000 Goto et al. ..... 219/216
6,423,941 B1 * 7/2002 Kanari et al. ..... 219/216
6,671,471 B2 12/2003 Nakamura et al. ..... 399/69
6,952,553 B2 * 10/2005 Sakakibara et al. ..... 399/328
2002/0118978 A1 8/2002 Nakamura et al. ..... 399/69

FOREIGN PATENT DOCUMENTS

| | | |
|---|---|---|
| EP | 1237055 A1 | 9/2002 |
| JP | 8-137305 | 5/1996 |
| JP | 8-305191 | 11/1996 |
| JP | 2002-260825 | 9/2002 |
| JP | 2005-55783 | 3/2005 |
| JP | 2005-148460 | 6/2005 |

OTHER PUBLICATIONS

PCT/2006/315244; Written Opinion; Jul. 26, 2006.

* cited by examiner

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

The invention prevents cracking of heater that may occur when a fixing device becomes uncontrollable and provides an image forming apparatus that is advantageous from the viewpoint of recycling of parts. A heater support member that supports a heater during abnormal temperature rise is provided at a position at which a heater holder deforms greatly when abnormal temperature rise of the heater occurs.

10 Claims, 7 Drawing Sheets

IMAGE HEATING APPARATUS

This application is a continuation of International Application No. PCT/JP2006/315244, filed Jul. 26, 2006, which claims the benefit of Japanese Patent Application No. 2005-216150, filed Jul. 26, 2005.

BACKGROUND OF THE INVENTION

1. Field of the Invention

The present invention relates to an image heating apparatus that can be suitably used as a heat fixing device equipped in a copying machine or a printer, and more particularly to an image heating apparatus provided with a heater having a heat generating resistor provided on a substrate and an elastic roller that forms, in cooperation with the heater, a nip portion through which a recording material that bears an image is conveyed.

2. Description of the Related Art

A film type fixing device has been practically used as a fixing device equipped in a copying machine or a printer. The film type fixing device has a heater made of a ceramic material, a fixing film made of polyimide or stainless steel etc. whose inner circumference is in contact with the heater and a pressure roller that forms a fixing nip portion in cooperation with the heater with the fixing film between.

In a type of film type fixing device, an elastic layer made of a silicone rubber or the like is provided on the fixing film. The elastic layer provided on the fixing film makes it possible to fix a toner image on a recording material in a surrounding manner. For this reason, this type of fixing device is mainly used in a full color printer.

FIG. 10 is a cross sectional view of a film type fixing device. The film type fixing device has a heater 1000 made of a ceramic material and a heater holder 1001 made of a heat resistant resin that holds the heater, both of which are provided in the interior of the fixing film 1002. The heater holder 1001 holds the heater 1000 all along the longitudinal direction of the heater holder 1001. The fixing film 1002 is opposed to the pressure roller 1003 so that a fixing nip portion N is formed between them. A thermosensitive element 1004 such as a thermal fuse or a thermistor like a thermostatic switch is provided on the heater 1000. A recording material P on which a toner image t has been formed is conveyed in the direction indicated by an arrow, and the toner image t on the recording material P is heated and fixed in the fixing nip portion N. Among the thermosensitive elements, the thermal fuse and the thermostatic switch serve as a safety device that operates upon sensing the heat, when the temperature of the heater 1000 rises abnormally due to, for example, malfunction of control circuit, to shut down power supply to the heater 1000. Among the thermosensitive element, the thermistor is adapted to detect the temperature of the heater 1000.

In designing the device, it is necessary to take into consideration delay in response of the thermosensitive element 1004 that may occur in the case where it cannot respond to rapid rise in the temperature of the heater 1000 when the temperature of the heater 1000 rises abnormally. When the abnormal heat generation by the heater continues due to delay in response of the thermosensitive element, the heater 1000 is likely to crack at the position at which the thermosensitive element 1004 is in contact with the heater 1000. The reason for this is as follows.

The heater holder 1001 is pressurized by the pressure roller 1003 from the heater side 1000 as shown in FIGS. 11A and 11B. The heater holder 1001 made of a heat-resistant resin has a hole 1001*a* into which the thermosensitive element for detecting the temperature is to be fitted, as shown in FIG. 11A. The rigidity of the heater holder is lower at the portion provided with the hole than the other portions of the heater holder. Accordingly, when the temperature of the heater 1000 rises abnormally, the portion provided with the hole is more likely to deform than the other portions of the heater holder, as shown in FIG. 11B. For this reason, a high stress acts on the portion of the heater 1000 that is adjacent to the portion of the heater holder provided with the hole, which leads to cracking of the heater 1000.

As a countermeasure against such heater cracking occurring at the position adjacent to the thermosensitive element 1004, a structure in which the hole into which the thermosensitive element is to be fitted is reinforced by a rib or the like has been proposed, as disclosed in Japanese Patent Application Laid-Open No. 2005-148460.

The structure disclosed in Japanese Patent Application Laid-open No. 2005-148460 is effective in reinforcing a heater holder to prevent bending of the heater itself in the case where the heater holder 1001 is prone to bend at the position of the hole upon abnormal temperature rise of the heater, namely in the case where the rigidity of the heater holder 1001 is low. Therefore, this structure is effective in preventing breakage of the heater 1000.

However, in the case where the rigidity of the heater holder is ensured to some extent, reinforcing the periphery of the hole into which the thermosensitive element is to be fitted is not sufficient in preventing cracking of the heater, in some cases.

This will be explained in the following with reference to FIG. 12A. As shown in FIGS. 12A and 12B, the heater 1001 is provided with a hole 1001*a* into which a thermosensitive element for detecting the temperature is to be fitted. When the temperature of the heater rises abnormally to reach the softening temperature of the heater holder, the seating portion of the heater holder that is in direct contact with the heater is softened. Since the heater 1000 is pressurized to the upward direction in FIGS. 12A and 12B by the pressure roller 1000, the heater sinks into the heater holder as shown in FIG. 12B when the heater seating surface of the heater holder is softened.

The temperature of the portion of the heater that is adjacent to the hole for the thermosensitive element rises exceedingly as compared to the other portions, since the heat in that portion is not taken away by the heater holder. Therefore, the portion of the seating surface of the heater holder that is adjacent to the hole for the thermosensitive element is likely to be softened. Accordingly, the portion of the heater that is adjacent to the hole for the thermosensitive element sinks into the heater holder by an amount larger than that in the other portions. Thus, the stress acting on the portion of the heater adjacent to the hole and its periphery becomes high, and there is a possibility that the heater may break.

As per the above, the conventional solution is not effective in the case where the phenomenon that the heater sinks into the heater holder due to softening of the heater seating surface of the heater holder occurs rather than bending of the heater holder.

Furthermore, a further increase in the speed of image forming apparatuses has been demanded in recent years. To increase the speed, it is necessary to give a larger quantity of heat to the recording material in a shorter time. This requires to supply a larger electric power to the heater to increase the overall quantity of heat generated.

When the power supplied to the heater becomes large, if the fixing device becomes uncontrollable for failure of a temperature control system or other reasons and a large amount of power is continuously supplied to the heater, high temperatures at which the seating surface of the heater holder easily melts are reached. Accordingly, the heater sinks into the heater holder, and the time until cracking of heater occurs is shortened. Therefore, cracking of the heater can occur, in some cases, before the thermosensitive element such as a thermostatic switch works.

When cracking of the heater occurs in this way, the heater cannot be used any longer, which is disadvantageous from the viewpoint of recycling of parts. In addition, there is the problem that a sufficient distance cannot be left between a portion to which the primary voltage is applied via a thermistor or the like provided on the heater and the secondary circuit or the ground portion. This sometimes leads to breakage of the secondary circuit, and an additional repair cost may be incurred.

SUMMARY OF THE INVENTION

The present invention has been made in view of the above described problems, and has as an object to provide an image heating apparatus in which cracking of the heater can be prevented.

According to the present invention, there is provided an image heating apparatus for heating an image formed on a recording material, comprising a heater having a substrate and a heat generating resistor provided on the substrate, a holder made of a resin that holds the heater along a longitudinal direction of the heater, an elastic roller that forms a nip portion, through which the recording material is conveyed, in cooperation with the heater, a thermosensitive element that senses heat from the heater, the thermosensitive element being fitted in a hole provided at a portion on the holder with respect to a longitudinal direction of the holder, a spring that urges the thermosensitive element toward the heater, and a support portion provided only at a position on the holder that is adjacent to the hole with respect to the longitudinal direction of the holder, the support portion having a clearance from the thermosensitive element, wherein when abnormal heat generation by the heater occurs and a portion of the holder in the vicinity of the hole is softened, the support portion receives a load placed on the heater via the thermosensitive element.

According to another aspect of the present invention, there is provided an image heating apparatus for heating an image formed on a recording material, comprising a heater having a substrate and a heat generating resistor provided on the substrate, a holder made of a resin that holds the heater along a longitudinal direction of the heater, an elastic roller that forms a nip portion, through which the recording material is conveyed, in cooperation with the heater, a thermosensitive element that senses heat from the heater, the thermosensitive element being fitted in a hole provided at a portion on the holder with respect to a longitudinal direction of the holder, a spring that urges the thermosensitive element toward the heater, and a spring support member that receives an end of the spring that is opposite to its thermosensitive element side end, the spring support portion having a support portion in the form of a projection having a clearance from the thermosensitive element, wherein when abnormal heat generation by the heater occurs and a portion of the holder in the vicinity of the hole is softened, the support portion receives a load placed on the heater via the thermosensitive element.

Further features of the present invention will become apparent from the following description of exemplary embodiments with reference to the attached drawings.

DESCRIPTION OF THE EMBODIMENTS

First Embodiment (Description of Structure of Fixing Device)

A fixing device according to a first embodiment of the present invention will be described with reference to FIGS. 1 and 2.

Figure 1:
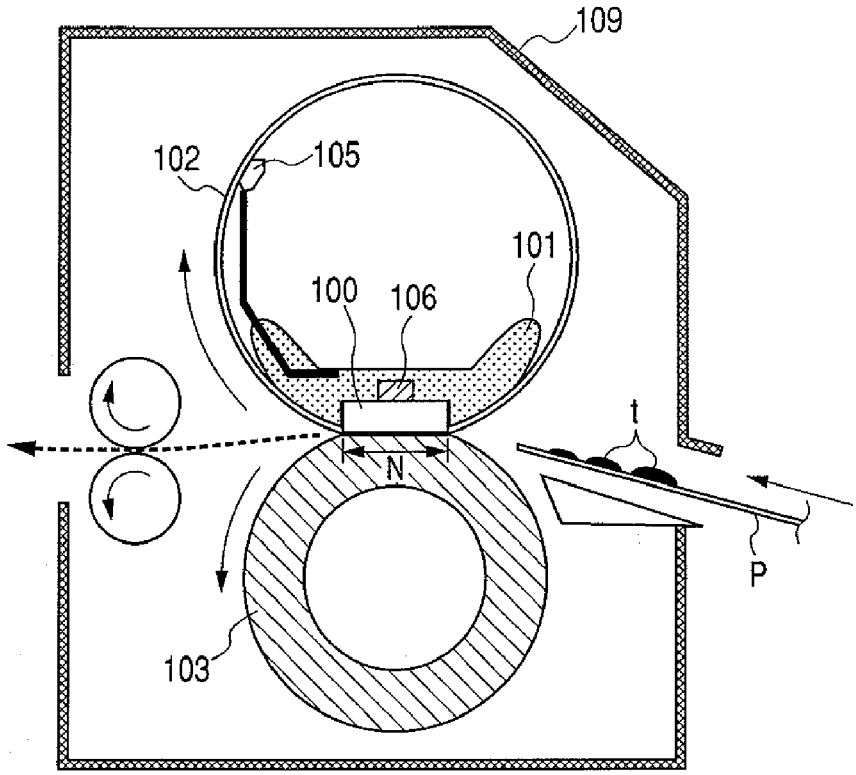
FIG. 1 is a cross sectional view of a fixing device according to the present invention.

FIG. 1 is a cross sectional view of the fixing device according to the first embodiment. FIG. 2 is a plan view showing the longitudinal surface of the heater in the first embodiment.

The fixing device according to the first embodiment is comprised of a heater 100, a heater holder 101, a fixing belt (or flexible sleeve) 102, a pressure roller (or elastic roller) 103 and thermistors (or thermosensitive elements) 105, 106.

Figure 2:
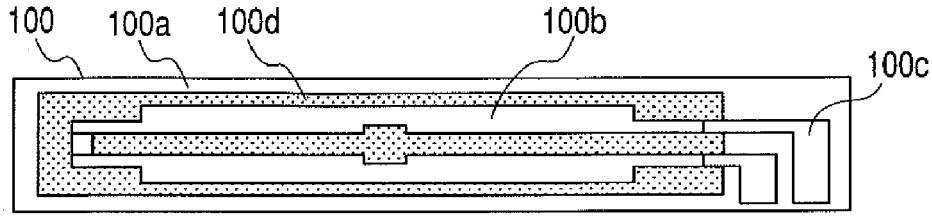
FIG. 2 is a plan view of a heater in a first embodiment of the present invention.

The heater 100 is comprised of a substrate 100*a*, a heat generating resistor 100*b*, an electrode 100*c* and an insulation coating layer 100*d* as shown in FIG. 2.

The substrate 100*a* may be made of an insulating ceramic material such as alumina or aluminum nitride. In this embodiment, use is made of a longitudinal aluminum nitride substrate having a thickness of 0.6 mm with its longitudinal direction being oriented in the direction perpendicular to the sheet conveyance direction. The length of the substrate 100*a* is 285 mm and the width is 7.5 mm.

The heat generating resistor 100*b* used in this embodiment is produced by applying an electrically conductive paste containing an alloy of silver and palladium on the substrate 100*a* by screen printing to form a film with a thickness of 20 μm, and then sintering it. The value of resistance of the heat generating resistor 100*b* used in this embodiment is 14 Ω. Accordingly, the electric power consumption of the heater 100 in the case where a voltage of 120 V is applied is 1029 W.

The heat generating resistor 100*b* has portions having a width smaller than the other portions, as both end portions thereof with respect to the longitudinal direction and as a portion in contact with a thermostatic switch 119 that will be described later. By reducing the width of the heat generating resistor 100*b*, the resistance of the heat generating resistor 100*b* is increased in the reduced width portions, and the quantity of heat generated with the same current becomes larger accordingly. This compensates, in the longitudinal end portions, the heat carried away toward the longitudinal ends through the substrate 100*a*, and compensates, in the portion in contact with the thermostatic switch, the heat taken away by the thermostatic switch so that a uniform temperature distribution in the heater is achieved along the longitudinal direction. The reduced width portions at the longitudinal ends of the heat generating resistor include a position on which a sub thermistor 106 (which will be described later) is arranged.

Electrodes 100*c* serve as electric contacts for allowing electric power supply to the heat generating resistor 100*b* from the power source of the fixing device or the image forming apparatus. The electrodes 100*c* in this embodiment are formed by applying a silver paste by screen printing to form a film with a thickness of 20 μm, and then sintering it, in a manner similar to formation of the heat generation resistive member 100*b*. The electrodes 100*c* are formed at two positions on the substrate 100*a*, each electrode 100*c* is connected to the heat generating resistor 100*b*. Thus, AC voltage is applied to the heat generating resistor 100*b* through the electrodes 103.

The insulation coating layer 100*d* is formed using an insulating material such as a glass or resin in order to ensure a dielectric voltage of the heat generating resistor 100*b* and the electrodes 100*c*. In this embodiment, a coating layer made of an insulating glass with a thickness of 80 μm is formed by screen printing over the heat generating resistor 100*b* to cover the substrate 100*a* and the heat generating resistor 100*b*.

The heater 100 is held by the heater holder 101. The heater holder 101 is molded using an engineering plastic reinforced by glass fiber, such as a liquid crystal polymer made of a fully aromatic polyester resin or the like. The heater holder 101 not only holds the heater 100 but also guides the fixing belt 102. The liquid crystal polymer used in this embodiment is Zenite 7755M (registered trademark) sold by DuPont. The upper allowable temperature limit during the continuous use of Zenite 7755M is approximately 270° C.

The fixing belt 102 is produced by forming a base layer in the form of a cylindrical endless film made of a polyimide resin or a metal such as nickel or stainless steel, forming a silicone rubber layer on the base layer using ring coating or other method and forming thereon a fluoroplastic layer with a thickness of 30 μm to 50 μm.

The base layer used in the fixing belt 102 in this embodiment is a stainless steel endless film with a thickness of 50 μm.

It is desired, from the viewpoint of achieving quick temperature rise, to use a material of the silicone rubber layer having as high a thermal conductivity as possible thereby making the heat capacity of the fixing belt 102 small. The silicone rubber used in this embodiment has a thermal conductivity of $1.0\times10^{-3}$ cal/sec·cm·K, which is relatively high as the thermal conductivity of silicone rubbers.

On the other hand, from the viewpoint of enhancing image quality in terms of overhead transparency (OHT) and suppression of minute unevenness in gloss on the image surface, it is desired to make the thickness of the rubber layer of the fixing belt 102 as large as possible. It has been known from a study made by the inventors that to obtain satisfactory image quality, a rubber thickness of 200 μm or more is needed. The silicone rubber layer in this embodiment has a thickness of 250 μm.

The fluoroplastic layer on the surface of the fixing belt 102 is provided to enhance surface releasability. By providing the releasing layer, it is possible to prevent offset phenomenon, which occurs when toner t once adheres to the surface of the fixing belt 102 and then is transferred to the recording material P again. By using a PFA tube as the fluoroplastic layer, it is possible to form a uniform fluoroplastic layer more easily.

In this embodiment, the fixing belt 102 is covered with a PFA tube with a thickness of 30 μm.

The pressure roller 103 is produced by forming on a stainless steal core a silicone rubber layer with a thickness of approximately 3 mm by injection molding and covering it with a PFA resin tube with a thickness of approximately 40 μm.

The pressure roller is attached to the frame 109, and the fixing belt 102 in which the heater holder 101 and the heater 100 are housed is provided above the pressure roller. The fixing belt 102 is pressurized by a pressurizing mechanism (not shown) with a force of 15 kgf (i.e. 7.5 kgf for each side). The pressurizing mechanism is provided with a pressurization canceling mechanism (not shown) so that when, for examply, clearing paper jam or other troubles, it is possible to cancel the pressurization to allow easy removal of the recording material P.

The thermistors 105, 106 are provided in order to detect the temperature of the inner surface of the fixing belt 102 and the temperature of the backside surface of the heater 100 and to control the temperature. In this embodiment, two thermistors are provided, that is, a main thermistor 105 and a sub thermistor 106.

The main thermistor 105 is constructed by attaching a thermistor element to an end of an arm made of a stainless steel. The arm is adapted to swing so that the thermistor element is always kept in contact with the inner surface of the fixing belt 102 even in the state in which the movement of the inner surface of the fixing belt 102 is unstable.

The sub thermistor 106 is fixed in such a way as to be in contact with the backside surface of the heater 100.

The main thermistor 105 and the sub thermistor 106 are connected with the CPU 117. The CPU 117 is adapted to determine how to control the temperature of the heater 100 based on temperature information from the main thermistor 105 and the sub thermistor 106 and to control the output power of the power source 118. With supply of electric power determined and controlled by the CPU from the power source 118, the temperature of the heater 100 is kept constant so that fixing of the toner image on a recording material P is performed.

On the backside of the heater 100 is provided a thermostatic switch 119 serving as a safety device. The thermostatic switch 119 is in contact with the heater 100. The thermostatic switch is provided to prevent, when the fixing device becomes uncontrollable, breakage of the fixing device which may occur when electric power is continuously supplied to the heater 100. The thermostatic switch operates when the temperature of the heater 100 rises abnormally and exceeds the operating temperature of the thermostatic switch, to shut down power supply to the heater 100, thereby stopping generation of heat from the heater 100.

In the fixing device of this embodiment, the fixing belt 102 is driven to rotate with the rotation of the pressure roller 103. The inner surface of the fixing belt 102 and the heater 100 slide relative to each other in the fixing nip portion N. Grease is applied on the inner surface of the fixing belt 102 to ensure sliding of the heater 100 and the inner surface of the fixing belt 102.

A recording material P that bears an unfixed toner image is introduced between the fixing belt 102 and the pressure roller 103 in the fixing nip portion N in the state in which the pressure roller 103 is driven to rotate, the fixing belt 102 rotates with the rotation of the pressure roller 103, the heater 100 is supplied with power, and the temperature of the heater 100 has been raised to a predetermined temperature and is controlled. The recording material P is held and conveyed between the fixing nip portion N together with the fixing belt 102 with the side of the recording material P that bears the toner image being in close contact with the outer surface of the fixing belt 102. During this holding-conveying process, the heat generated by the heater 100 is given to the recording material P through the fixing belt 102, so that the unfixed toner image on the recording material P is heated and pressurized. Thus, the toner image is melted and fixed. The recording material P having passed through the fixing nip portion N is separated from the surface of the fixing belt 102 and further conveyed for discharge.

Figure 3:
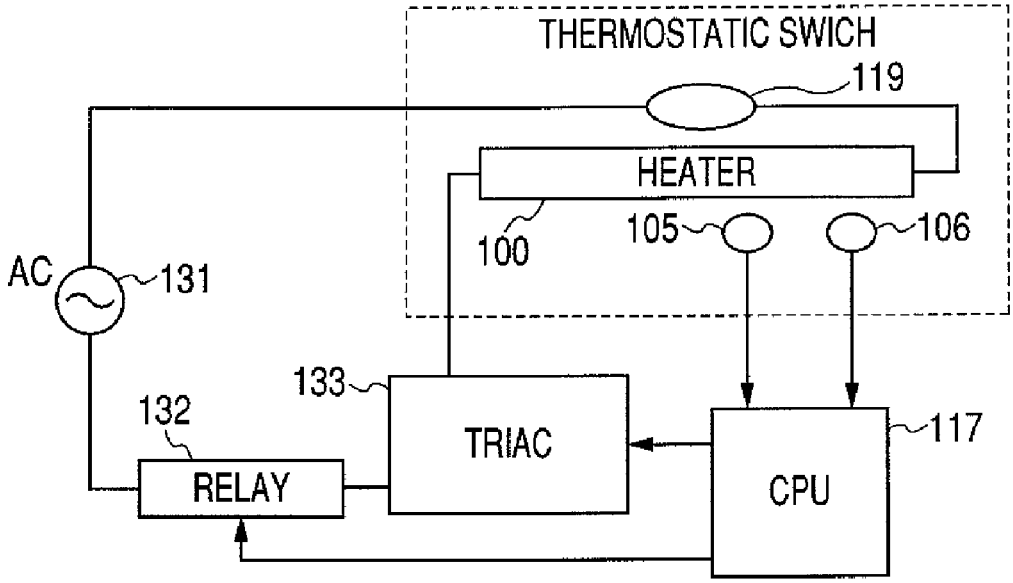
FIG. 3 is a circuit diagram of an electric power control circuit in the first embodiment of the present invention.

A control circuit for controlling power supply to the heater 100 in this embodiment will be described with reference to FIG. 3.

The circuit of the temperature control system is composed of an AV power source 131, a relay 132, a triac 133, the thermostatic switch 119 serving as a safety device, and the heater 100 that generates heat with supply of electric power from the power source 131. These compenents are connected in series.

The triac 133 is adapted to turn on/off the power supply from the AC power source 131 based on the result of calculation by the CPU 117 to control the temperature of the heater 100 to a predetermined temperature.

The relay 132 is designed to become open based on a command signal from the CPU 117, when, for example, the temperature of the heater 100 rises abnormally, to break the conduction between the power source 131 and the heater 100.

The thermistor 106 for detecting the temperature of the heater 100 is in contact with the backside surface of the heater 100. The thermistor 106 is connected with the CPU 117. The CPU 117 determines the power to be supplied to the heater 100 based on temperature information from the thermistors 105 and 106 and control the output power of the power source 118. With supply of electric power determined and controlled by the CPU from the power source 118, the temperature of the heater 100 is kept constant so that fixing of the toner image on a recording material P is performed. In the fixing device according to this embodiment, the CPU 117 controls the triac 133 in such a way that the temperature detected by the main thermistor 105 is kept at a control target temperature. In addition, when the temperature detected by the sub thermistor 106 exceeds a predetermined temperature, the CPU 117 executes a control to decrease the control target temperature for the main thermistor 105 or increase the recording sheet feeding interval.

Figure 4:
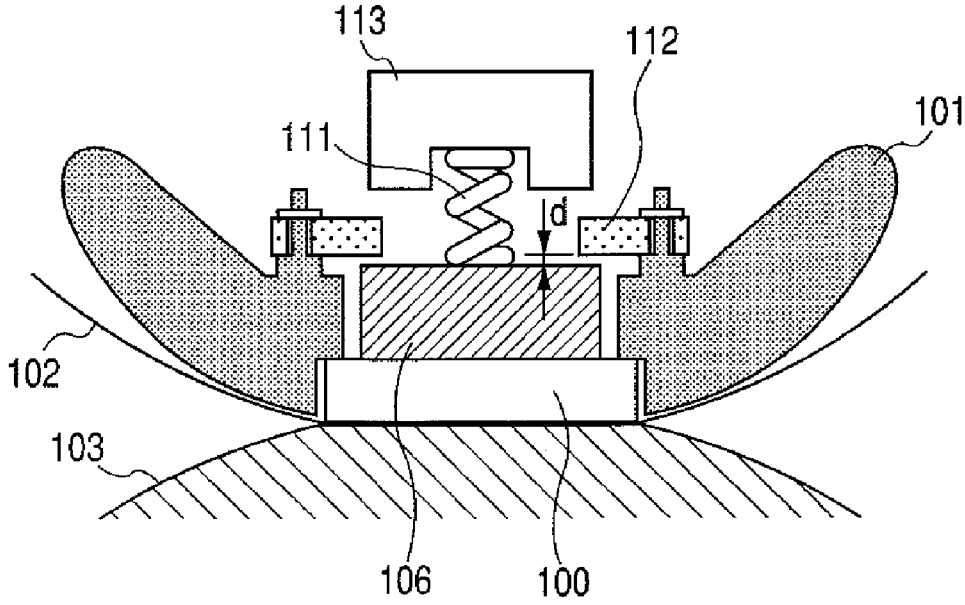
FIG. 4 is a cross sectional view of the fixing device according to the first embodiment of the present invention taken near a position at which a thermosensitive element is provided.
Figure 9:
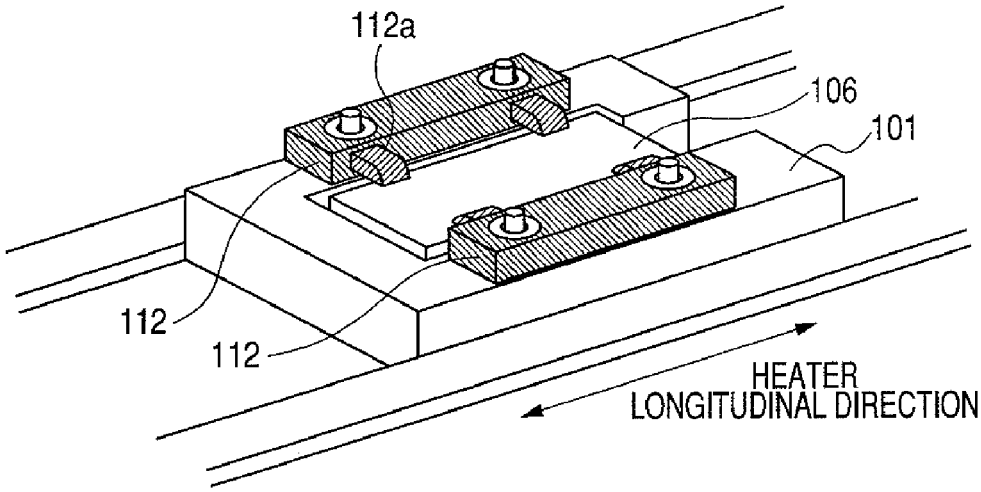
FIG. 9 is an enlarged perspective view of a support portion shown in FIG. 4 and its vicinity.
Figure 10:
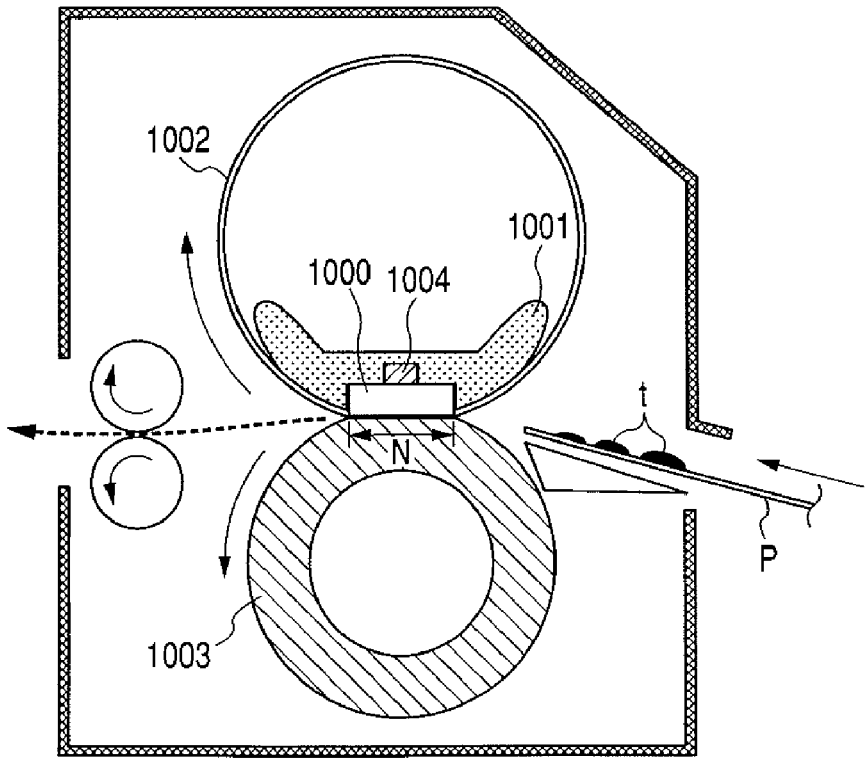
FIG. 10 is a cross sectional view of a conventional film type fixing device.
Figure 11A:
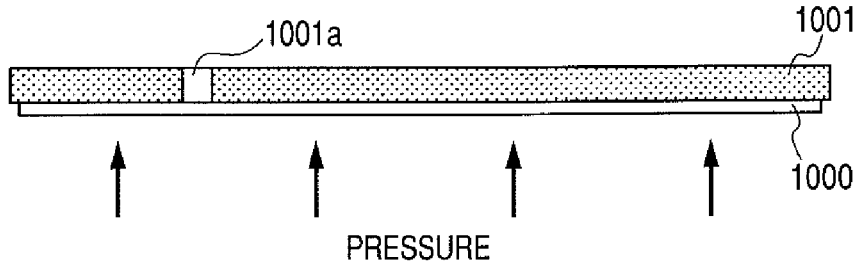
FIG. 11A and FIG. 11B illustrate deformation of a conventional heater holder having a low rigidity that may be caused by runaway of the heater.
Figure 11B:
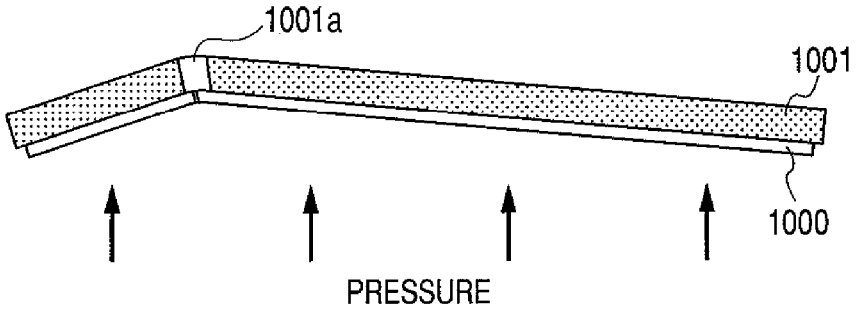
Figure 12A:
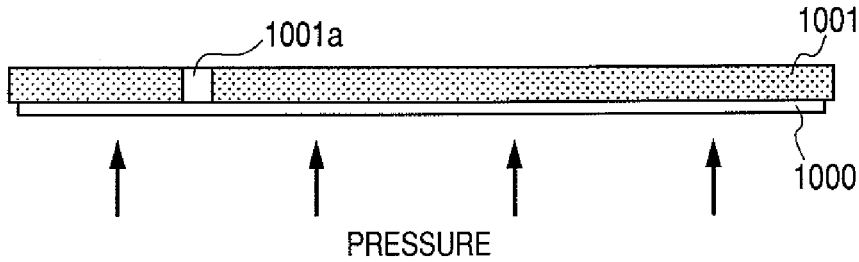
FIG. 12A and FIG. 12B illustrate deformation of a conventional heater holder having a high rigidity that may be caused by runaway of the heater.
Figure 12B:
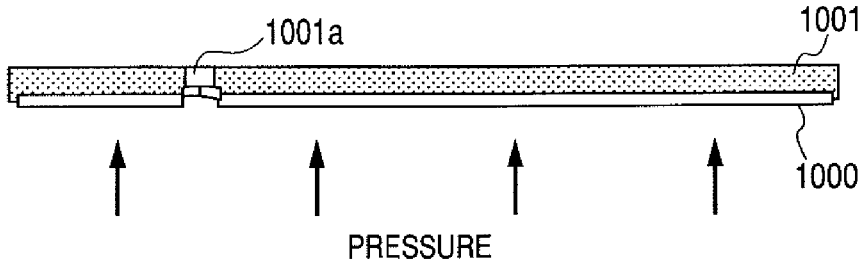

FIG. 4 is a cross sectional view of the fixing device according to this embodiment taken near the position at which the sub thermistor 106 is provided. FIG. 9 is an enlarged perspective view of a support portion that will be described later and its vicinity.

The sub thermistor 106 is fitted into a hole for the sub thermistor on the heater holder 101 and pressed toward the heater 100 by a sub thermistor pressing spring 111 so as to be retained.

What is designated by reference numeral 112 is the heater support member that operates when abnormal temperature rise of the heater 100 occurs. The heater support member (support portion) 112 is provided with a predetermined clearance d from the surface of the sub thermistor 106 that is opposite to the surface in contact with the heater 100. The heater support member 112 is attached to the heater holder 101. At least three support portions 112*a* of the heater support member 112 are provided for one thermosensitive element. In this embodiment, four support portions 112*a* are provided.

In the case of this embodiment, substantially the whole of the backside surface (i.e. the surface facing away from the nip portion) of the heater 100 is supported by the heater holder 101 except for the portion adjacent to the hole of the heater holder 101. In such a structure, it is preferred that the clearance d be in the range of $0\ \text{mm} < d \leqq 1\ \text{mm}$.

When the temperature of the heater 100 rises abnormally to reach the softening temperature of the heater holder 101, the seating surface of the heater holder 101 that is directly in contact with the heater 100 is softened, so that the heater 100 sinks into the heater holder 101. In particular, the portion around the hole of the heater holder 101 is easily softened. At the time when the heater sinks by a depth equal to the aforementioned clearance d, the heater support member 112 comes in contact with the sub thermistor 106 to support the heater 100 by way of the sub thermistor 106. In other words, when abnormal heat generation by the heater occurs and the portion around the hole of the heater holder is softened, the heater support portion receives the load placed on the heater by way of the thermosensitive element (sub thermistor).

In connection with this, it is not desirable that the heater support portion is in contact with the thermosensitive element when the temperature of the heater is in the normal temperature range (for example when the temperature of the heater is within the temperature range during normal fixing process or when the temperature of the heater is equal to the room temperature). This is because in such a situation, it is not possible to control the thermosensitive element pressing force exerted by the sub thermistor pressing spring 111. If the heater support portion is in contact with the thermosensitive element when the temperature of the heater is within the normal temperature range, a load is placed on the heater, which is likely to cause cracking of the heater though abnormal heat generation by the heater is not occurring.

As described above, the heater support member 112 supports the heater 100 to receive the pressing force exerted by the pressure roller 103. Thus, the heater 100 is prevented from sinking, at the position of the hole in which the thermistor is fitted, into the heater holder 101 by a depth larger than the aforementioned clearance d, and the stress acting on the heater 100 can be reduced. When the thermostatic switch 119 operates while the heater support member 112 supports the heater 100, the abnormal heat generation by the heater 100 is stopped. Then, the sinking of the heater can be stopped, and bending of the heater can be prevented, accordingly. This means that the heater support member 112 plays an additional role of giving an elongated time for the thermostatic switch 119 to operate.

In view of the fact that the more the amount by which the heater 100 sinks into the heater holder is reduced to make the stress acting on the heater 100 smaller, the more hardly the heater cracks, it is desirable that the clearance d between the heater support member 112 and the sub thermistor 106 be made as small as possible. It is preferred that the clearance d be in the range of 0 mm<d≦1 mm, as described before. The clearance d in this embodiment is 0.1 mm.

(Excessive Power Supply Test)

We conducted an excessive power supply test on this fixing apparatus.

This excessive power supply test was conducted under the condition in which the rate of the temperature rise of the heater 100 became the highest. Specifically, the triac 303 in the control circuit was broken intentionally to make it conductive in both directions, and the relay 132 was short-circuited.

Under this condition, power was supplied from the AC power source so that the maximum power was continuously supplied to the heater. The voltage applied was 140 volts, which was higher by 10% than the rated voltage of 127 volts in the highest voltage area among the 120V areas. The temperature of the room in which the fixing device was placed was 25° C. and the humidity was 50%. Therefore, the temperature of the heater at the time power supply was started was 25° C.

During the experiment, the fixing device was not rotated but kept in a stationary state. The reason why the experiment was conducted while keeping the fixing device stationary is that in the rotating state, the energy supplied to the heater 100 is consumed in heating the pressure roller 103, and the fixing device is damaged less in the rotating state than in the stationary state.

(Result of Excessive Power Supply Test)

We conducted the excessive power supply test five times under the above described condition, but cracks of the heater 100 were not formed in any of the tests. In these tests, we measured the time from the start of the power supply to the heater to the start of the operation of the thermostatic switch 119, or the time from the start of the power supply to the heater until the power supply to the heater 100 was shut down. The time was 4.0 seconds at maximum, 3.2 seconds at minimum and 3.5 seconds on the average.

Furthermore, in the excessive power supply test, in order to measure the time until cracking of the heater 100, we conducted, three times, the test of short-circuiting the thermostatic switch 119 and continuously supplying power until the heater 100 cracked. The times elapsed from the start of the power supply to the heater until the heater 100 cracked in the respective tests were 5.4 seconds, 5.4 seconds and 5.0 seconds. This means that if the thermostatic switch 119 works within 5.0 seconds from the start of the power supply to the heater, cracking of the heater can be prevented. The thermostatic switch used in this test worked approximately 4.0 seconds after the start of the power supply at the latest. It will be understood from the above that a time margin of at least 1.0 seconds (5.0 seconds minus 4.0 seconds) for operation of the thermostatic switch is ensured in preventing cracking of the heater. It can be said from this that in the fixing device according to this embodiment, even under the most adverse condition in terms of cracking of the heater, the thermostatic switch 119 works before the heater 100 cracks, and sufficient safety is ensured.

COMPARATIVE EXAMPLE 1

The fixing device used in comparative example 1 is substantially the same as that in the first embodiment except that a heater support member is not provided at the position at which a sub thermistor 106 is provided.

We conducted the excessive power supply test five times on the fixing device according to comparative example 1 having the construction as described above in a manner similar to the test on the first embodiment.

The result was that cracking of the heater 100 occurred in four tests out of five. Namely, the heater cracked sooner than operation of the thermostatic switch in some cases. The portions at which cracks were formed were portions adjacent to the hole to which the thermistor was fitted.

We measured the time from the start of the power supply to the heater until the thermostatic switch 119 operated, or the time until the heater broke and the power supply was shut down. The time was 4.0 seconds at maximum, 3.3 seconds at minimum and 3.5 seconds on the average.

Furthermore, in the excessive power supply test, in order to measure the time until cracking of the heater 100 we conducted, three times, the test of short-circuiting the thermostatic switch 119 and continuously supplying power until the heater 100 cracked. The times elapsed from the start of the power supply to the heater until the heater 100 cracked in the respective cases were 4.1 seconds, 3.7 seconds and 3.4 seconds. It will be understood from this that in this comparative example, the time until operation of the thermostatic switch 119 and the time until cracking of the heater 100 is substantially equal to each other. This means that in this comparative example, there is little time margin for operation of the thermostatic switch in preventing heater cracking, even though the thermostatic switch may operate before the heater cracks.

In the arrangement of this comparative example, there is no means for preventing sinking of the heater 100 in the portion adjacent to the hole on the heater holder 101, and a high stress acts on the heater. This was the cause of cracking of the heater 100.

From the above, it will be understood that the time until cracking of the heater or the time margin for operation of the thermostatic switch in preventing cracking of the heater can be lengthened by providing an support member 112 as is the case with this embodiment.

At least three heater support members 112 are provided for one thermosensitive element. Thus, the position of the thermosensitive element is stabilized when supported by the heater support members 112, and the stress acting on the heater can be reduced effectively.

Second Embodiment

The second embodiment is characterized by that heater support portions and a heater holder are integrally molded.

Figure 5:
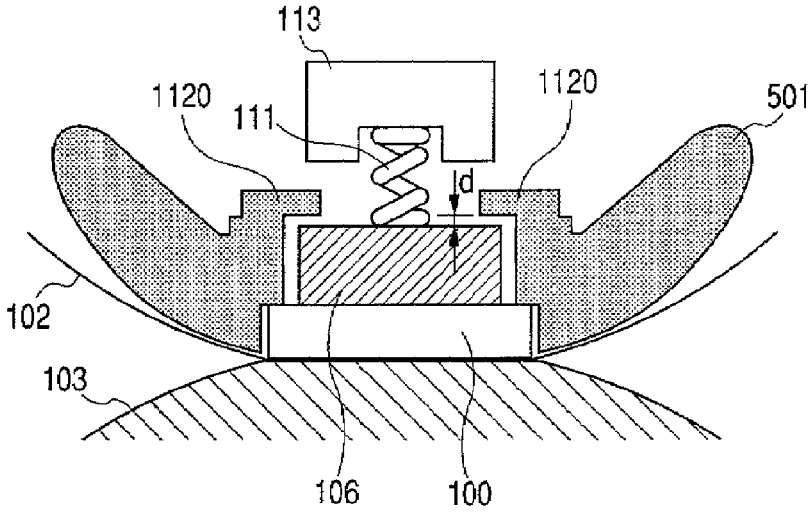
FIG. 5 is a cross sectional view of a fixing device according to a second embodiment of the present invention taken near a position at which a thermosensitive element is provided.

FIG. 5 is a cross sectional view of a fixing device according to this embodiment taken near the position at which a sub thermistor is provided.

The heater support portions 1120 and the heater holder 501 are integrally molded, and therefore dimensions along the vertical directions can be controlled finely. Thus, it is possible to define the clearance d between the sub thermistor 106 and the heater support member finely, and stable support of the heater can be expected when abnormal temperature rise of the heater occurs.

In the structure of this embodiment, it is possible to make the clearance d smaller than that in the first embodiment. In the second embodiment, the clearance between the sub thermistor 106 and the heater support member is designed to be 0.05 mm.

(Result of Excessive Power Supply Test)

We conducted the excessive power supply test five times on the second embodiment under the condition same as that in the test on the first embodiment. Cracking of the heater 100 did not occur in any of the tests. In the test, we measured the time from the start of the power supply to the heater until the thermostatic switch 119 turned off to shut down the power supply to the heater 100. The time was 3.9 seconds at maximum, 3.3 seconds at minimum and 3.5 seconds on the average.

In order to measure the time until cracking of the heater 100 while power is supplied, we also conducted, three times, the test of short-circuiting the thermostatic switch 119 and continuously supplying power until the heater 100 cracked. The times elapsed from the start of the power supply to the heater until the heater 100 cracked in the respective tests were 5.3 seconds, 5.5 seconds and 5.5 seconds.

It can be said from the above that the thermostatic switch 119 works before the heater 100 cracks under the most adverse condition in terms of cracking of the heater, and sufficient safety is ensured.

In addition, by integrally molding the heater support portion 1120 and the heater holder 501, the time until cracking of the heater can be made stable. In this embodiment also, it is preferred that at least three heater support portions 1120 be provided for one thermosensitive element.

Third Embodiment

The fixing device used in the third embodiment is substantially the same as that in the second embodiment, except that a recess is provided on the heater contact surface of the heater holder so that a layer of air is present between the heater and the heater holder.

Figure 6A:
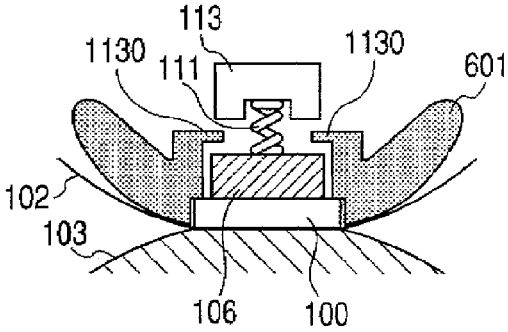
FIG. 6A is a cross sectional view of a fixing device according to a third embodiment of the present invention taken near a position at which a thermosensitive element is provided.
Figure 6B:
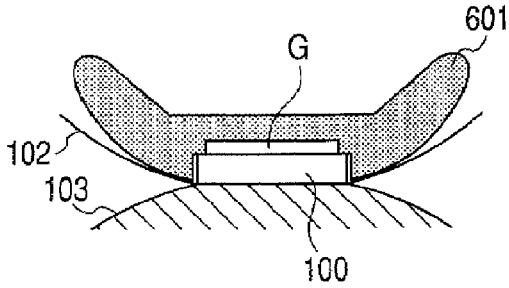
FIG. 6B is a cross sectional view of a fixing device according to the third embodiment of the present invention taken at a position at which the sub thermosensitive element is not provided.

FIG. 6A is a cross sectional view of the fixing device according to this embodiment taken near the position at which the sub thermistor is provided. FIG. 6B is a cross sectional view of the fixing device taken at a position at which the sub thermistor is not provided.

As shown in FIG. 6B, the heater seating surface of the heater holder 601 is constructed in such a way that an air layer G is formed between the heater 100 and the heater holder 601. This structure is intended to reduce the transmission of heat generated by the heater 100 to the heater holder 601 to thereby enhance heat efficiency.

In this embodiment, the clearance d between the sub thermistor 106 and the heater support portions 1130 of the heater holder 601 is 0.3 mm, which is equal to the thickness of the air layer G between the heater 100 and the heater holder 601.

In such a structure in which an air layer G is present between the heater 100 and the heater holder 601, the heat of the heater 100 is hardly drawn by the heater holder 601. Accordingly, when abnormal temperature rise occurs, the temperature of the heater rises greatly, and the heater seating surface of the heater holder is likely to be softened. Consequently, the heater 100 sinks into the heater holder 601 relatively rapidly.

As the heater 100 sinks into the heater holder 601, the air layer G gradually disappears.

When the air layer G disappears, the heater and the heater holder are in contact with each other all over the surface of the heater except for the portion adjacent to the hole in which the thermistor is fitted, and the heat of the heater is easily taken away by the heater holder. Thus, the temperature rise of the heater is made moderate and the speed of sinking of the heater 100 into the heater holder 601 becomes lower.

On the other hand, in the vicinity of the hole in which the thermistor is fitted, the area of contact of the heater and the heater holder changes little between before and after the disappearance of the air layer G. Accordingly, the temperature of that portion of the heater continues to rise, and the heater tends to sink further into the heater holder.

In this embodiment, the clearance d between the sub thermistor 106 and the heater support portions 1130 is made equal to the thickness of the air layer G. Therefore, at the time when the air layer G disappears, the heater support portions 1130 come in contact with the sub thermistor 106 to support the heater 100 via the sub thermistor 106.

By arranging the heater support members in such a way as to support the heater 100 and receive the pressurizing force from the pressure roller 103, it is possible to prevent the heater 100 from sinking further into the heater holder 101 at the position of the hole in which the thermistor is fitted. Thus, stress acting on the heater can be reduced.

(Result of Excessive Fixing Power Supply Test)

We conducted the excessive power supply test five times on the third embodiment under the condition same as that in the test on the first embodiment. Cracking of the heater 100 did not occur in any of the tests. In the test, we measured the time from the start of the power supply to the heater until the thermostatic switch turned off to shut down the power supply to the heater 100. The time was 3.7 seconds at maximum, 3.2 seconds at minimum and 3.4 seconds on the average.

In order to measure the time until cracking of the heater 100 while the power is supplied, we also conducted, three times, the test of short-circuiting the thermostatic switch 119 and continuously supplying power until the heater 100 cracked. The times elapsed from the start of the power supply to the heater until the heater 100 cracked in the respective cases were 6.0 seconds, 5.9 seconds and 6.2 seconds.

As per the above, in the fixing device having the structure in which an air layer is present between the heater and the heater holder also, it is possible to ensure sufficient safety by designing the clearance d between the sub thermistor and the heater support portions appropriately. In the case where an air layer or a gap G is provided between the heater and the heater holder like in this embodiment, it is preferred that the heater support portions 1130 and the thermosensitive element 106 come in contact with each other when the gap G disappears due to softening of the heater holder. Therefore, it is preferred that the clearance d be in the range G mm$\leqq$d$\leqq$G+0.5 mm.

Fourth Embodiment

The fourth embodiment is characterized by that heater support portions are provided on a spring support member that urges a thermosensitive element. In this embodiment, the heater support portions are provided at a position at which a thermostatic switch is provided rather than at the position at which a sub thermistor is provided.

Figure 7:
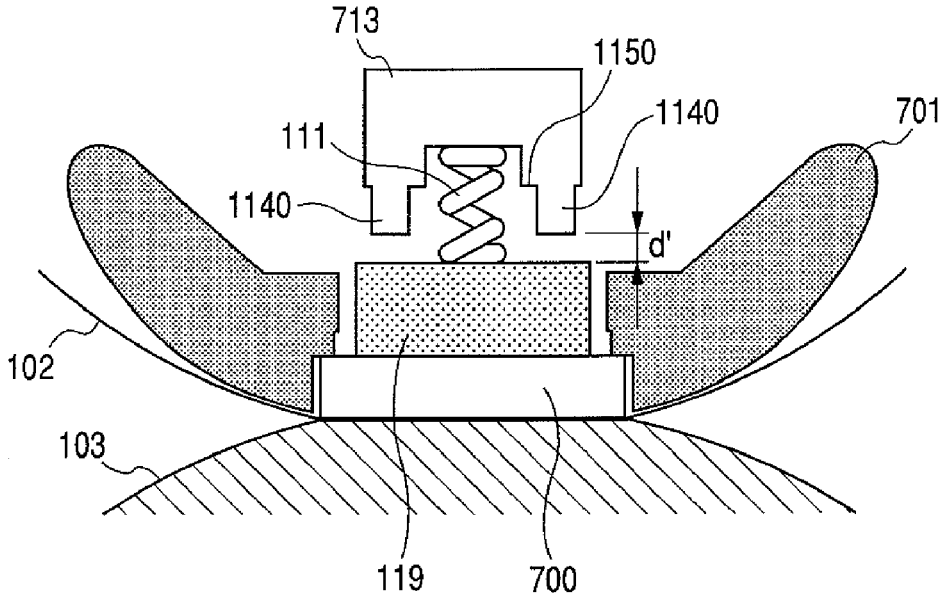
FIG. 7 is a cross sectional view of a fixing device according to a fourth embodiment of the present invention taken near a position at which a thermosensitive element is provided.
Figure 13:
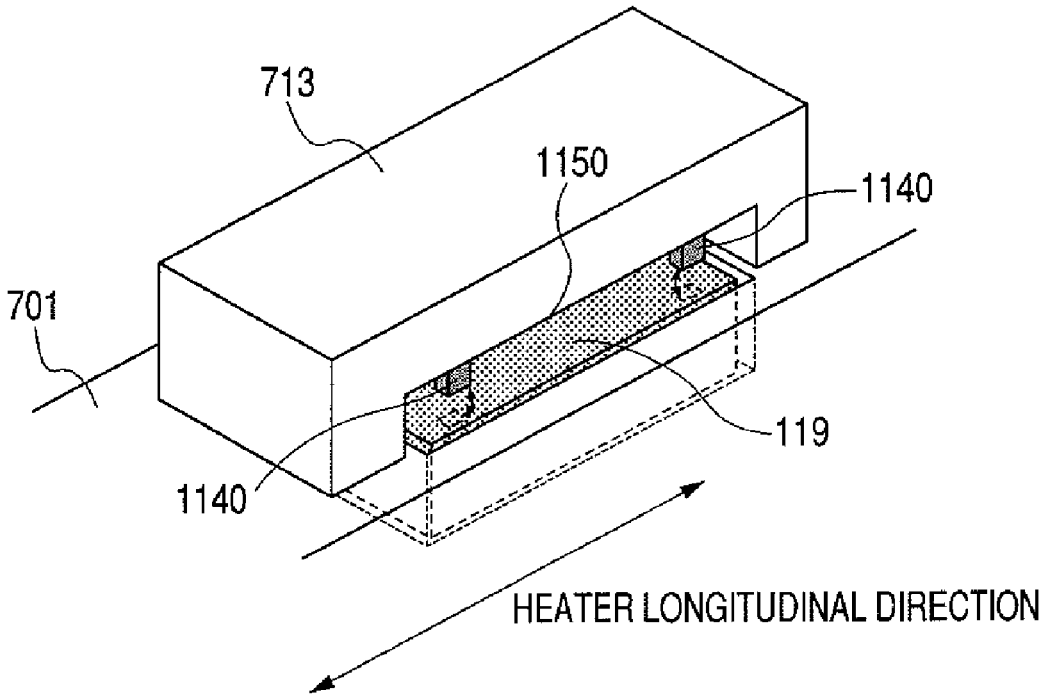
FIG. 13 is an enlarged perspective view of a support portion shown in FIG. 4 and its vicinity.

FIG. 7 is a cross sectional view of the fixing device according to this embodiment taken near the position at which the thermostatic switch is provided. FIG. 13 is an enlarged perspective view of the heater support portions 1140 shown in FIG. 7 and its vicinity.

The thermostatic switch 119 is fitted in a hole for the thermostatic switch provided on the heater holder 701 and urged against the heater 700 by a thermostatic switch pressing spring 111 so as to be retained.

In this embodiment, an air layer G is present between the heater 700 and the heater holder 701 as with the third embodiment.

The heater support portions 1140 in this embodiment are molded integrally with a thermostatic switch pressing spring support member 713 made of a resin. During normal use (i.e. while abnormal heat generation by the heater is not occurring), the heater support portions 1140 are positioned in such a way as to have a clearance d' from the thermostatic switch 119. In this embodiment, the clearance d' is 0.3 mm, which is equal to the thickness of the air layer G between the heater 700 and the heater holder 701. The heater support portion 1140 in this embodiment is shaped like a projection protruding from a flat surface 1150 of the spring support member 713. At least three such projections are provided. In other words, the heater support portions 1140 in the form of projections protrude from the surface 1150 at least three positions. It is preferred to regulate the thermostatic switch 119 by the heater support portions 1140 in the form of projections rather than by the flat surface 1150, since the clearance d' can be controlled precisely. In addition, it is preferred that the clearance d' be in the range of G mm$\leqq$d$\leqq$G+0.5 mm.

Figure 8:
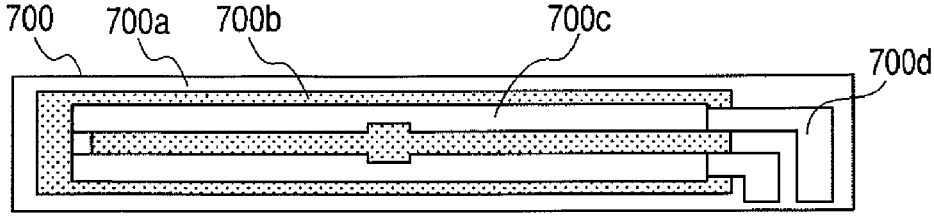
FIG. 8 is a plan view of a heater in the fourth embodiment of the present invention.

FIG. 8 shows a heat generating resistor used in this embodiment.

The heater 700 used in this embodiment has substantially the same structure as the heater 100 in the first embodiment, but the substrate 700*a* is made of alumina and has a thickness of 1.0 mm.

The shape of the heat generating resistor 700*b* is also different from that in the first embodiment in that the width of the heat generating resistor at both longitudinal end portions is the same as the width of the other portions. Namely, the width of the heat generating resistor is reduced only in the portion in contact with the thermostatic switch 119. This is because the thermal conductivity of alumina is small as compared to that of aluminum nitride, and the quantity of heat carried away toward the longitudinal ends through the substrate 700*a* is small.

In this embodiment, since the width of the heat generating resistor 700*b* is not reduced in both longitudinal end portions of the heater, when the temperature of the heater 700 rises abnormally, the temperature of the portion in contact with the thermostatic switch 119 in which the width is reduced rises most rapidly. Therefore, heater support portions 1140 are provided at the position at which the thermostatic switch is provided thereby making it possible to prevent cracking of the heater effectively.

The time until operation of the thermostatic switch 119 changes with its contact pressure against the heater 700. As the contact pressure of the thermostatic switch 119 against the heater 700 increases, the time until the thermostatic switch 119 operates becomes shorter, and its variations becomes smaller.

In this embodiment, when the temperature of the heater 700 rises abnormally, the thermostatic switch 119 is secured by the heater support portions 1140. Thus, when the heater 700 is about to sink into the heater holder 701 and a force is exerted on the heater 700, the thermostatic switch 119 abuts the heater 700 with a large abutment pressure.

Consequently, the time until the thermostatic switch 119 operates becomes short and regular as compared to in the case where not heater support member 1140 is provided. Accordingly, this structure is advantageous in preventing cracking of the heater.

(Result of Excessive Power Supply Test)

We conducted the excessive power supply test five times on the fourth embodiment under the condition same as that in the test on the first embodiment. Cracking of the heater 700 did not occur in any of the tests. In the test, we measured the time from the start of the power supply to the heater until the thermostatic switch 119 turned off to shut down the power supply to the heater 700. The time was 3.8 seconds at maximum, 3.1 seconds at minimum and 3.3 seconds on the average.

In order to measure the time until cracking the heater 700 while power is supplied, we also conducted, three times, the test of short-circuiting the thermostatic switch 119 and continuously supplying power until the heater 700 cracked. The times elapsed from the start of the power supply to the heater until the heater 700 cracked in the respective tests were 5.0 seconds, 5.4 seconds and 5.1 seconds.

It can be said from the above that in this embodiment, the thermostatic switch 119 works before the heater 700 cracks under the most adverse condition in terms of cracking of the heater, and sufficient safety is ensured.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-216150, filed Jul. 26, 2005, which is hereby incorporated by reference herein in its entirety.

What is claimed is:

1. An image heating apparatus for heating an image formed on a recording material, comprising:

a heater having a substrate and a heat generating resistor provided on said substrate;

a holder made of a resin that holds said heater along a longitudinal direction of said heater;

an elastic roller that forms a nip portion, through which the recording material is conveyed, in cooperation with said heater;

a thermosensitive element that senses heat from said heater, said thermosensitive element being fitted in a hole provided at a portion on said holder with respect to a longitudinal direction of said holder;

a spring that urges said thermosensitive element toward said heater; and a support portion provided only at a position on said holder that is adjacent to said hole with respect to the longitudinal direction of said holder, said support portion having a clearance from said thermosensitive element, wherein when abnormal heat generation by said heater occurs and a portion of said holder in the vicinity of said hole is softened, said support portion receives a load placed on said heater via said thermosensitive element.

2. An image heating apparatus according to claim 1, wherein said support portion is provided at at least three positions for one said thermosensitive element.

3. An image heating apparatus according to claim 1, wherein said thermosensitive element is any one of a thermistor, a thermostatic switch and a thermal fuse.

4. An image heating apparatus according to claim 1, wherein a value of resistance of an area of said heat generating resistor adjacent to said thermosensitive element is higher than that of the other areas.

5. An image heating apparatus according to claim 1, further comprising a flexible sleeve that rotates with said heater being in contact with its inner circumferential surface, and said nip portion is formed by said heater and said elastic roller with said sleeve therebetween.

6. An image heating apparatus for heating an image formed on a recording material, comprising:

a heater having a substrate and a heat generating resistor provided on said substrate;

a holder made of a resin that holds said heater along a longitudinal direction of said heater;

an elastic roller that forms a nip portion, through which the recording material is conveyed, in cooperation with said heater;

a thermosensitive element that senses heat from said heater, said thermosensitive element being fitted in a hole provided at a portion on said holder with respect to a longitudinal direction of said holder;

a spring that urges said thermosensitive element toward said heater; and a spring support member that receives an end of said spring that is opposite to its thermosensitive element side end, said spring support member having a support portion in the form of a projection having a clearance from said thermosensitive element, wherein when abnormal heat generation by said heater occurs and a portion of said holder in the vicinity of said hole is softened, said support portion receives a load placed on said heater via said thermosensitive element.

7. An image heating apparatus according to claim 6, wherein said support portion is provided at at least three positions for one said thermosensitive element.

8. An image heating apparatus according to claim 6, wherein said thermosensitive element is any one of a thermistor, a thermostatic switch and a thermal fuse.

9. An image heating apparatus according to claim 6, wherein a value of resistance of an area of said heat generating resistor adjacent to said thermosensitive element is higher than that of the other areas.

10. An image heating apparatus according to claim 6, further comprising a flexible sleeve that rotates with said heater being in contact with its inner circumferential surface, and said nip portion is formed by said heater and said elastic roller with said sleeve therebetween.

* * * * *

UNITED STATES PATENT AND TRADEMARK OFFICE

CERTIFICATE OF CORRECTION

PATENT NO. : 7,269,365 B2
APPLICATION NO. : 11/626056
DATED : September 11, 2007
INVENTOR(S) : Keisuke Mochizuki et al.

It is certified that error appears in the above-identified patent and that said Letters Patent is hereby corrected as shown below:

COLUMN 1:
Line 33, “cross sectional” should read --cross-sectional--.

COLUMN 3:
Line 23, “above” should read --above- --.

COLUMN 4:
Line 7, “cross sectional” should read --cross-sectional--;
Line 13, “cross sectional” should read --cross-sectional--;
Line 17, “cross sectional” should read --cross-sectional--;
Line 21, “cross sectional” should read --cross-sectional--;
Line 24, “cross sectional” should read --cross-sectional--;
Line 28, “cross sectional” should read --cross-sectional--;
Line 36, “cross sectional” should read --cross-sectional--; and
Line 55, “cross sectional” should read --cross-sectional--.

COLUMN 6:
Line 34, “steal” should read --steel--; and
Line 45, “examply,” should read --example,--.

COLUMN 8:
Line 11, “cross sectional” should read --cross-sectional--.

COLUMN 9:
Line 48, “above described” should read --above-described--.

COLUMN 10:
Line 65, “cross sectional” should read --cross-sectional--.

UNITED STATES PATENT AND TRADEMARK OFFICE

CERTIFICATE OF CORRECTION

PATENT NO. : 7,269,365 B2
APPLICATION NO. : 11/626056
DATED : September 11, 2007
INVENTOR(S) : Keisuke Mochizuki et al.

It is certified that error appears in the above-identified patent and that said Letters Patent is hereby corrected as shown below:

COLUMN 11:
Line 47, "cross sectional" should read --cross-sectional--; and
Line 49, "cross" should read --cross- --.

COLUMN 13:
Line 4, "cross sectional" should read --cross-sectional--; and
Line 66, "becomes" should read --become--.

Signed and Sealed this

Twentieth Day of May, 2008

JON W. DUDAS
*Director of the United States Patent and Trademark Office*